US010193279B2

(12) United States Patent
Eriksson et al.

(10) Patent No.: US 10,193,279 B2
(45) Date of Patent: Jan. 29, 2019

(54) EXTENSION CORD, SOCKET AND COVER OF A SOCKET

(71) Applicant: ROMI SYSTEMS AB OY, Vasa (FI)

(72) Inventors: Ronny Eriksson, Overmalax (FI); Björn Still, Vasa (FI)

(73) Assignee: ROMI SYSTEMS AB OY, Vasa (FI)

( * ) Notice: Subject to any disclaimer, the term of this patent is extended or adjusted under 35 U.S.C. 154(b) by 0 days.

(21) Appl. No.: 15/566,432

(22) PCT Filed: Apr. 15, 2016

(86) PCT No.: PCT/FI2016/050252
§ 371 (c)(1),
(2) Date: Oct. 13, 2017

(87) PCT Pub. No.: WO2016/166420
PCT Pub. Date: Oct. 20, 2016

(65) Prior Publication Data

US 2018/0159274 A1 Jun. 7, 2018

(30) Foreign Application Priority Data

Apr. 15, 2015 (WO) ..... PCT/FI2015/050260

(51) Int. Cl.
*H01R 13/62* (2006.01)
*H01R 13/639* (2006.01)
(Continued)

(52) U.S. Cl.
CPC ..... *H01R 13/6392* (2013.01); *H01R 13/447* (2013.01); *H01R 13/5213* (2013.01);
(Continued)

(58) Field of Classification Search
CPC ..... H01R 13/6392; H01R 13/639; H01R 13/447; H01R 24/22; H01R 24/28; H01R 31/06; H01R 25/003; H01R 13/72
See application file for complete search history.

(56) References Cited

U.S. PATENT DOCUMENTS 5,122,069 A * 6/1992 Brownlie ..... G02B 6/4451 174/53
5,336,107 A 8/1994 Sheryll
(Continued)

FOREIGN PATENT DOCUMENTS

CN 201766225 U 3/2011
CN 202749567 U 2/2013
(Continued)

OTHER PUBLICATIONS

ABL Sursum: Industrial Plugs and Sockets, Oct. 2009.
(Continued)

*Primary Examiner* — Xuong Chung Trans
(74) *Attorney, Agent, or Firm* — Oliff PLC

(57) ABSTRACT

The present invention relates to an extension cord comprising a lead having a first end and a second end. The first end comprises a socket having a cover and the second end comprises a plug. The cover is attached to the socket by a hinged joint possessing a force which resists opening of the cover. The cover comprises a retainer. The present invention also relates to a socket having a cover and a cover of a socket.

12 Claims, 8 Drawing Sheets

(51) Int. Cl.

| | |
|---|---|
| ***H01R 13/447*** | (2006.01) |
| ***H01R 24/22*** | (2011.01) |
| ***H01R 13/52*** | (2006.01) |
| *H01R 24/30* | (2011.01) |
| *H01R 24/28* | (2011.01) |

(52) U.S. Cl.
CPC ..... *H01R 24/22* (2013.01); *H01R 24/28* (2013.01); *H01R 24/30* (2013.01)

(56) References Cited

U.S. PATENT DOCUMENTS

| | | | | |
|---|---|---|---|---|
| 5,911,586 | A | 6/1999 | Wintergerst | |
| 6,189,187 | B1 | 2/2001 | Williams | |
| 7,347,712 | B2 * | 3/2008 | O'Connell | H01R 13/447 439/373 |
| 7,442,873 | B2 * | 10/2008 | McCormick | H02B 1/28 174/50 |
| 7,540,767 | B1 * | 6/2009 | Czarnecki | G01R 1/0408 320/114 |
| 8,242,365 | B2 * | 8/2012 | Galasso | H02G 3/185 174/483 |
| 2011/0207362 | A1 | 8/2011 | Lifson | |
| 2014/0051273 | A1 | 2/2014 | Han et al. | |

FOREIGN PATENT DOCUMENTS

| | | | |
|---|---|---|---|
| CN | 203135054 | U | 8/2013 |
| CN | 203150847 | U | 8/2013 |
| DE | 10140294 | A1 | 3/2003 |
| EP | 1251600 | A1 | 10/2002 |
| JP | H01-265471 | A | 10/1989 |
| NL | 1032887 | C2 | 10/2008 |
| WO | 2004/068648 | A1 | 8/2004 |

OTHER PUBLICATIONS

Jul. 7, 2016 International Search Report issued in Patent Application No. PCT/FI2016/050252.

Jul. 7, 2016 Written Opinion issued in Patent Application No. PCT/FI2016/050252.

Sep. 17, 2018 Supplementary European Search Report issued in European Application No. 16 77 9666.

May 28, 2018 Office Action issued in Chinese Patent Application No. 201680002428.7.

Oct. 5, 2018 Office Action issued in Japanese Patent Application No. 2018-505540.

* cited by examiner

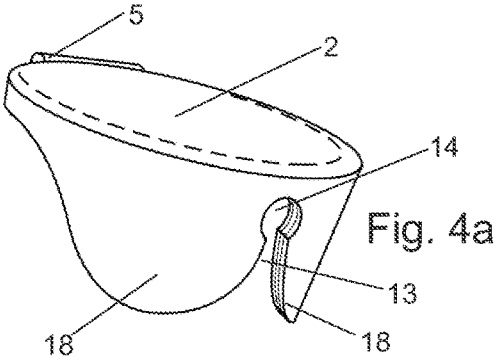
Fig. 4a
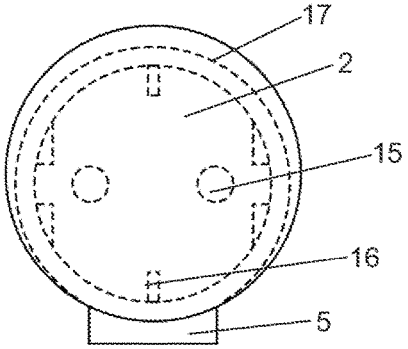
Fig. 4b
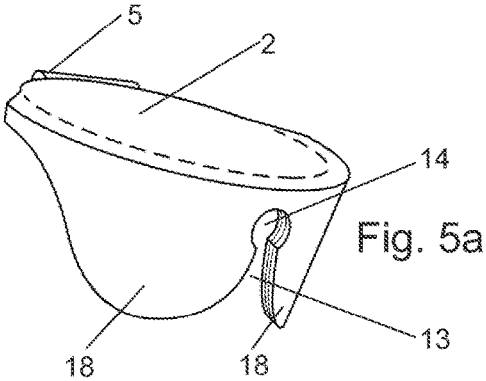
Fig. 5a
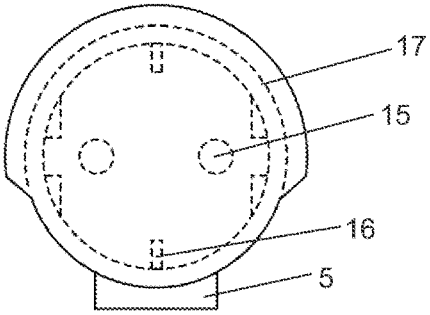
Fig. 5b
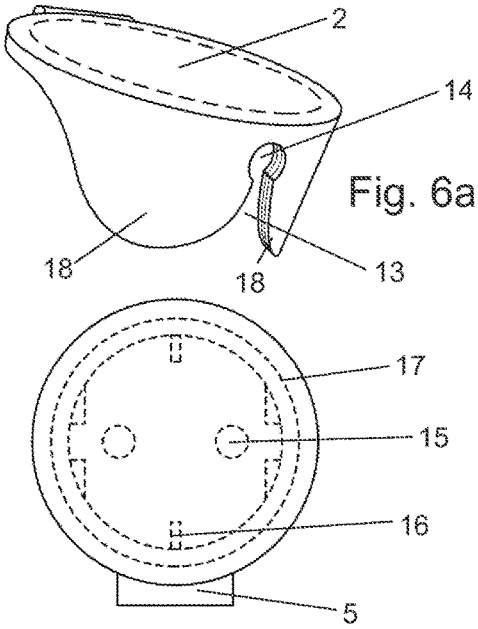
Fig. 6a
Fig. 6b

EXTENSION CORD, SOCKET AND COVER OF A SOCKET

FIELD OF THE INVENTION

The present invention relates to an extension cord comprising a lead having a first end and a second end, the first end comprising a socket having a cover and the second end comprising a plug, the cover being attached to the socket by a hinged joint possessing a force which resists opening of the cover. The present invention also relates to a socket having a cover, the cover being attached to the socket by a hinged joint possessing a force which resists opening of the cover and a cover of a socket.

BACKGROUND

Some prior art solutions are known. For example, U.S. Pat. No. 5,336,107 discloses a device for retaining an electrical plug and extension cord to another plug and extension cord employs fastener strip elements secured to the cord adjacent to the plug by a circumferential clamping element. When the electrical plug is engaged with a corresponding socket, the mechanical fastener elements secured to the plug engage cooperating fastening elements affixed to the corresponding socket to retain the assembly in its connected state.

The aim of the prior art solution is to keep the plug and the socket firmly attached. A problem related to the above-mentioned device is that it requires a counterpart, i.e. both the plug and the socket have to have fastener elements that fit to each other.

DESCRIPTION OF THE INVENTION

The aim of the invention is to overcome the above-mentioned problem. The extension cord of the invention, the socket of the invention and the cover of the invention are characterized in that the cover comprises a retainer.

The advantage of the present invention is that the retainer does not require a counterpart but it is universally usable. A user of the extension cord can use any available plug to attain a firm joint between the socket and the plug.

The invention is mainly utilized in connection of AC power sockets but also other uses are possible. The invention is not limited to be used in sockets according to any national/regional standard but can be utilized globally.

The extension cord comprises the plug, the lead and at least one socket. The plug comprises a front side and a rear side. The lead connected to the plug extends from the rear side of the plug and the front side of the plug includes pins for forming an electrical contact. The socket also comprises a front side and a rear side and a sheath between the front side and the rear side. The lead connected to the socket extends from the rear side of the socket and the front side of the socket includes receptacles for receiving the pins inside the sheath in order to form a joint between the plug and the socket. The front side of the socket is covered by the cover which is attached to the socket by a hinged joint. The hinged joint is normally on the front circumference of the sheath. The joint possesses a force that resists opening of the cover. The joint may be, for example, spring loaded in order to bring an adequate force to prevent the cover to open unintentionally.

The cover comprises a retainer that can be used with any plug. The cover covers the front side of the socket but also extends over the sheath. In such a manner the reach of the cover is increased so that the socket of the invention is not sensitive to the length variations of the plugs which can be connected to the socket. The cover reaches over the plug and the retainer in the cover grips to the rear side of the plug or to the lead extending from the rear side of the plug in order to keep the joint between the socket and the plug firm. If the connected plug is comparatively short then the cover is less open but if the connected plug is comparatively long then the cover is more open. Nevertheless, the retainer grips to the plug or the lead with such a force that keeps the plug and socket firmly attached although the extension cord is pulled. However, the joint will open if the pulling force is exceptionally strong.

The retainer comprises a slot in the edge of the cover. Further, the retainer may comprise a hole in the bottom of the slot, or partly overlapping successive holes form a slot that may decrease in width towards the bottom of the slot. The hole in the bottom of the slot keeps the lead in its place. When the partly overlapping successive holes form the slot and the slot increases in width towards the edge of the cover there are optional positions for retaining leads having different diameters. The number of the holes may vary.

The present invention can also be utilized in an extension reel. The extension reel is an extension cord that rolls up into the socket end, which in some cases has more than one socket on it.

Further, the present invention can be utilized in sockets which, for example, are wall mountable.

BRIEF DESCRIPTION OF THE DRAWINGS

In the following, the invention is described by referring to the drawings in which:

FIG. 1*a* shows a socket in front view;

FIG. 1*b* shows a socket in perspective view;

FIG. 1*c* shows a socket and a plug in perspective view;

FIG. 1*d* shows a socket in side view;

FIG. 2*a* shows a socket in front view;

FIG. 2*b* shows a socket in side view;

FIG. 2*c* shows a socket and a plug in perspective view;

FIG. 3*a* shows a cover in front view;

FIG. 3*b* shows a cover in side view;

FIG. 3*c* shows a cover in perspective view;

FIGS. 4*a* to 6*b* show covers of the invention;

FIG. 4*a* shows an oval cover in perspective view;

FIG. 4*b* shows an oval cover from above;

FIG. 5*a* shows a partially enlarged cover in perspective view;

FIG. 5*b* shows a partially enlarged cover from above;

FIG. 6*a* shows a completely enlarged cover in perspective view;

FIG. 6*b* shows a completely enlarged cover from above;

FIG. 7*a* shows a socket in front view;

FIG. 7*b* shows a socket in side view;

FIG. 7*c* shows a socket with a closed cover in perspective view;

FIG. 7*d* shows a socket and a plug in perspective view;

FIG. 7*e* shows a socket with an open cover in perspective view.

DETAILED DESCRIPTION OF THE INVENTION

FIGS. 1*a*-1*d* show a socket 1 having a front side 4 and a rear side 6. A lead 7 extends from the rear side 6 of the socket 1.

Figure 1A:
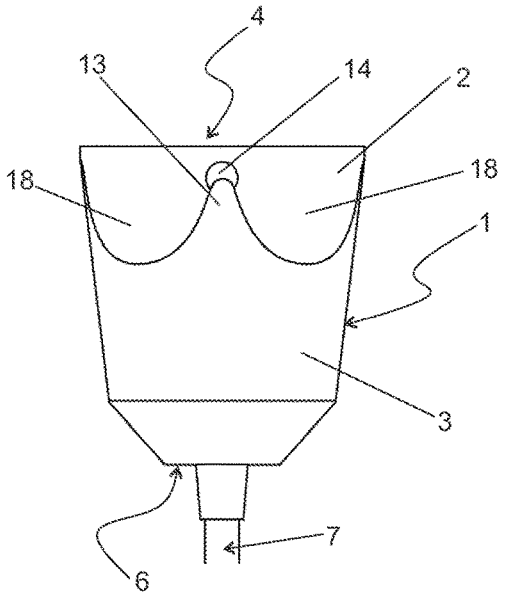
FIGS. 1*a* to 1*d* show a socket having an integrated cover.
Figure 1B:
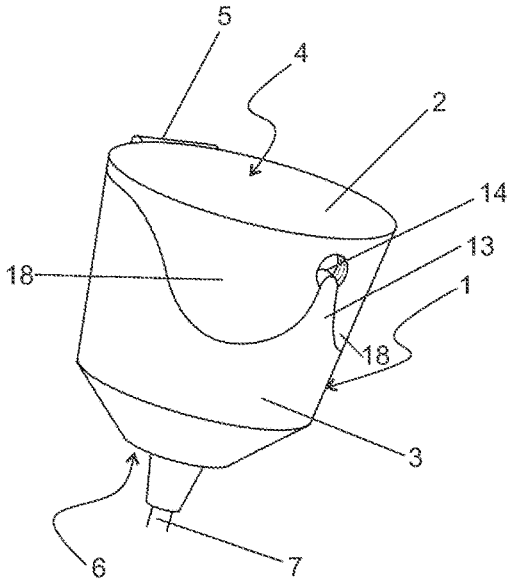
Figure 1C:
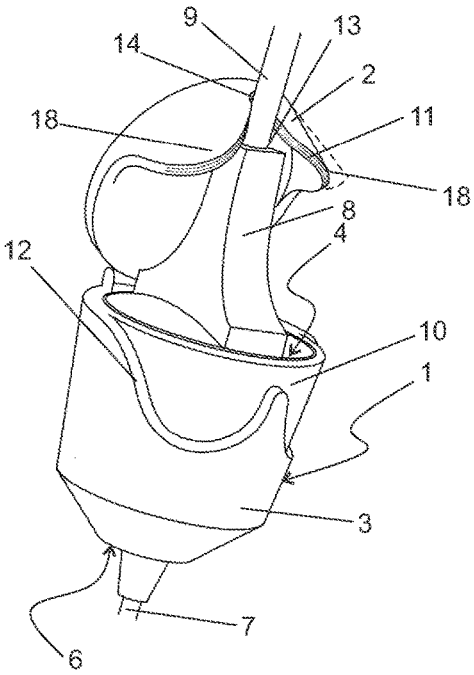
Figure 1D:
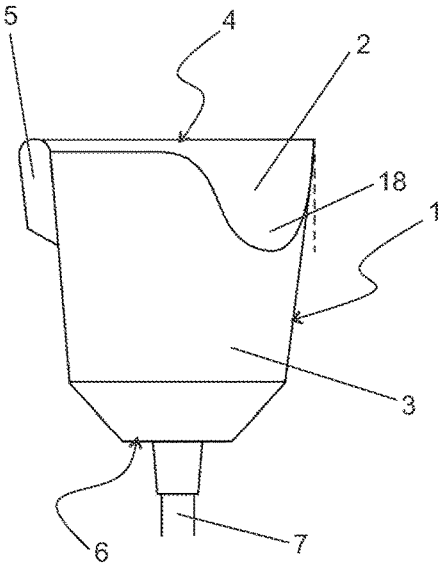

The socket 1 has an integrated cover 2, i.e. the cover 2 forms a part of the outer sheath 3 of the socket 1 as can be seen in FIG. 1*c*. The outer sheath 3 comprises a recession 10. The edge 12 of the recession 10 is compatible with the edge 11 of the cover 2. The cover 2 is fastened to the socket 1 with a hinge 5. The hinge 5 possesses a force which resists opening of the cover 2. In practice, such a force can be accomplished by a spring, i.e. the hinge 5 is spring loaded.

The cover 2 comprises a slot 13 surrounded by sleeves 18 and in the bottom of the slot 13 there is a hole 14. The slot 13 and the hole 14 form a retainer of the invention. In use, as can be seen from FIG. 1*c*, the cover 2 of the socket 1 is open but the force prevailing in the hinge 5 resists opening of the cover 2. The retainer engages the plug 8 and/or the lead 9. Depending on the size of the plug 8, the slot 13 may be responsible for capturing the plug 8, or the hole 14 may be responsible for capturing the lead 9. Due to the smart design of the cover 2, the invention can be applied with plugs with different shapes, sizes and standards.

Figure 2A:
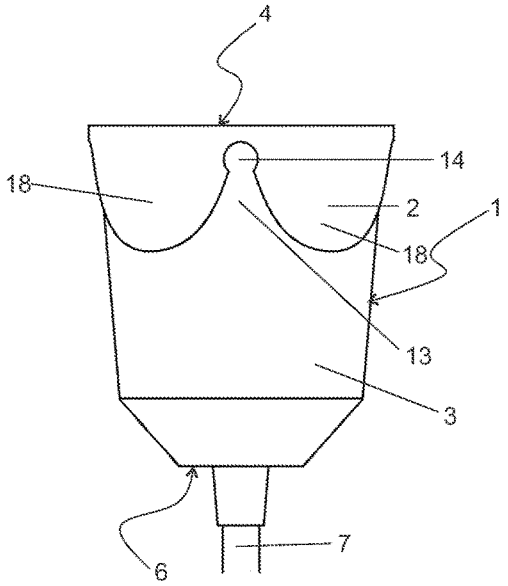
FIGS. 2*a* to 2*c* show a socket having a non-integrated cover.
Figure 2B:
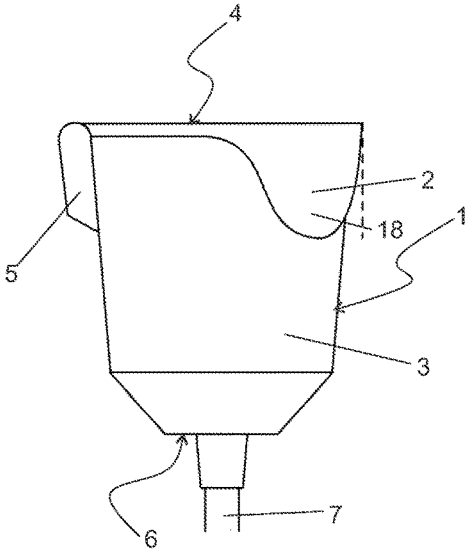
Figure 3A:
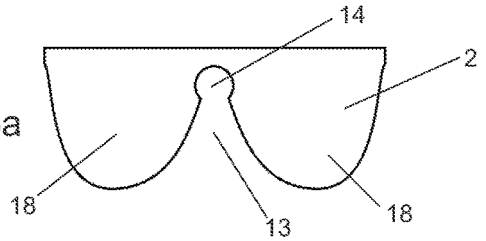
FIGS. 3*a* to 3*c* show a cover of a socket.
Figure 3B:
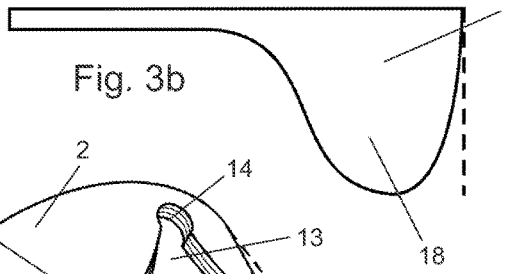
Figure 2C:
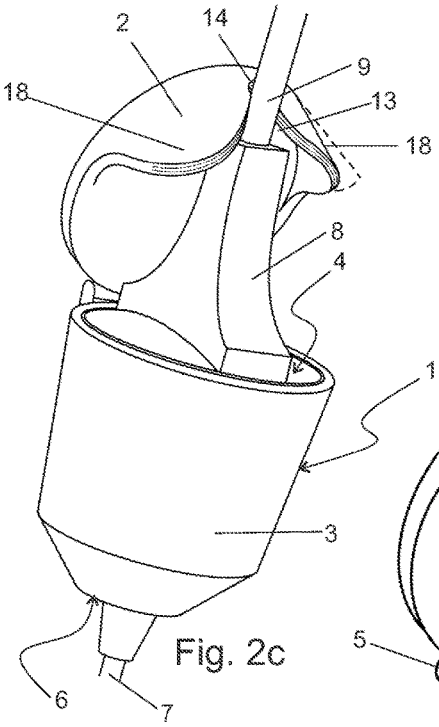
Figure 3C:
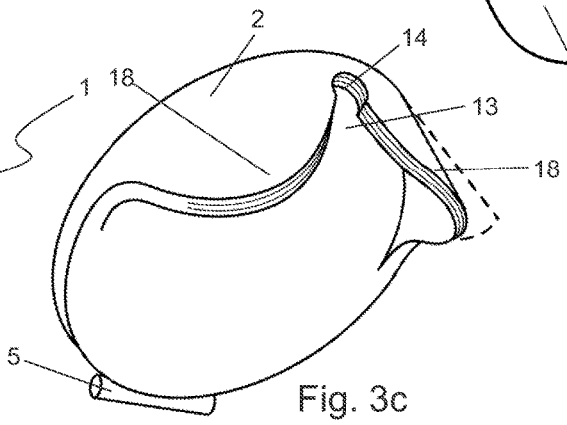

FIGS. 2*a* to 2*c* show a socket 1 with a non-integrated cover 2. In this socket, there is no recession in the outer sheath 3 but the cover 2 extends over the sheath 3. FIGS. 3*a* to 3*c* show the cover 2 alone.

FIGS. 4*a* to 6*b* show alternative possibilities to form the non-integrated cover 2. FIGS. 4*a* and 4*b* show an oval cover 2 which is capable of extending over the circumference of the sheath 3. Dashed lines in FIGS. 4*b*, 5*b* and 6*b* show the front side 4 of the socket 1 under the cover 2. The front side 4 comprises receptacles 15 to receive pins of the plug 8 and earthing clips 16. The circumference of the sheath is denoted by 17.

FIGS. 5*a* and 5*b* show a partially enlarged cover 2. A part of the circumference of the cover 2 is enlarged compared to the circumference 17 of the sheath 3. The center of the enlarged area is preferably opposite to the hinge 5, as shown in FIG. 5*b*.

FIGS. 6*a* and 6*b* show a completely enlarged cover 2. The whole circumference of the cover 2 is enlarged compared to the circumference 17 of the sheath 3.

Figure 7A:
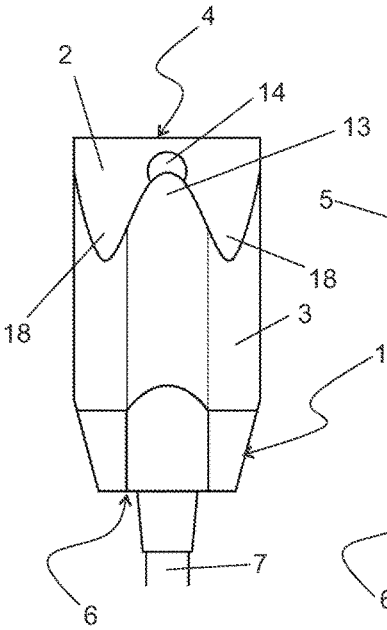
FIGS. 7*a* to 7*e* show a socket having a cover.
Figure 7B:
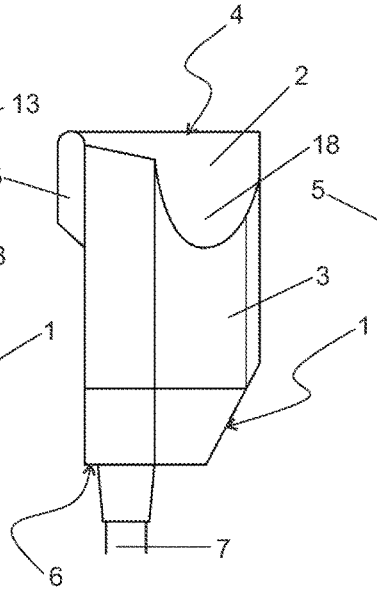
Figure 7C:
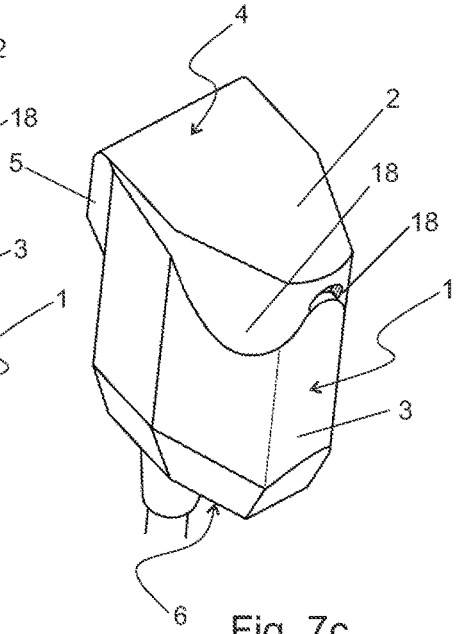
Figure 7D:
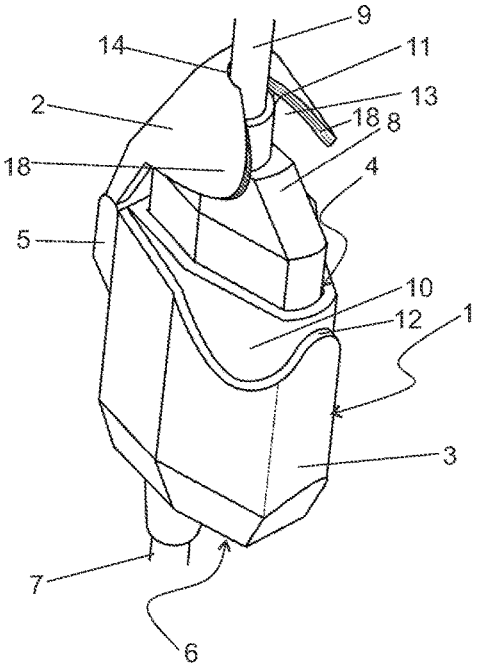
Figure 7E:
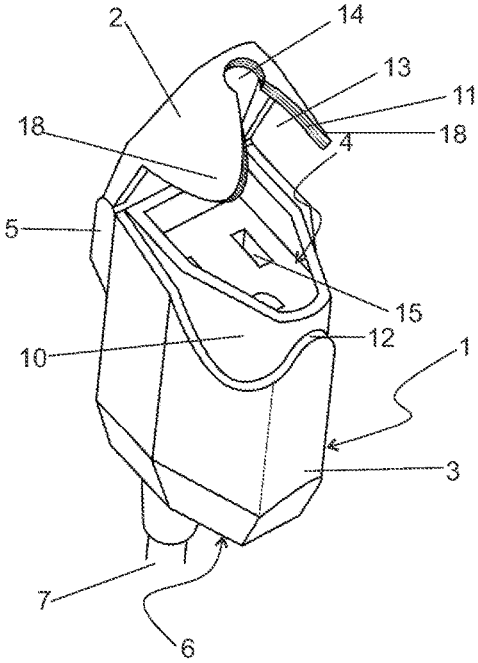

FIGS. 7*a* to 7*e* show a socket 1 and a plug 8 according to a different standard compared to the previous figures. However, the arrangement in FIGS. 7*a* to 7*b* is an analogue to the arrangement shown in FIGS. 1*a* to 1*d*.

Figure 8:
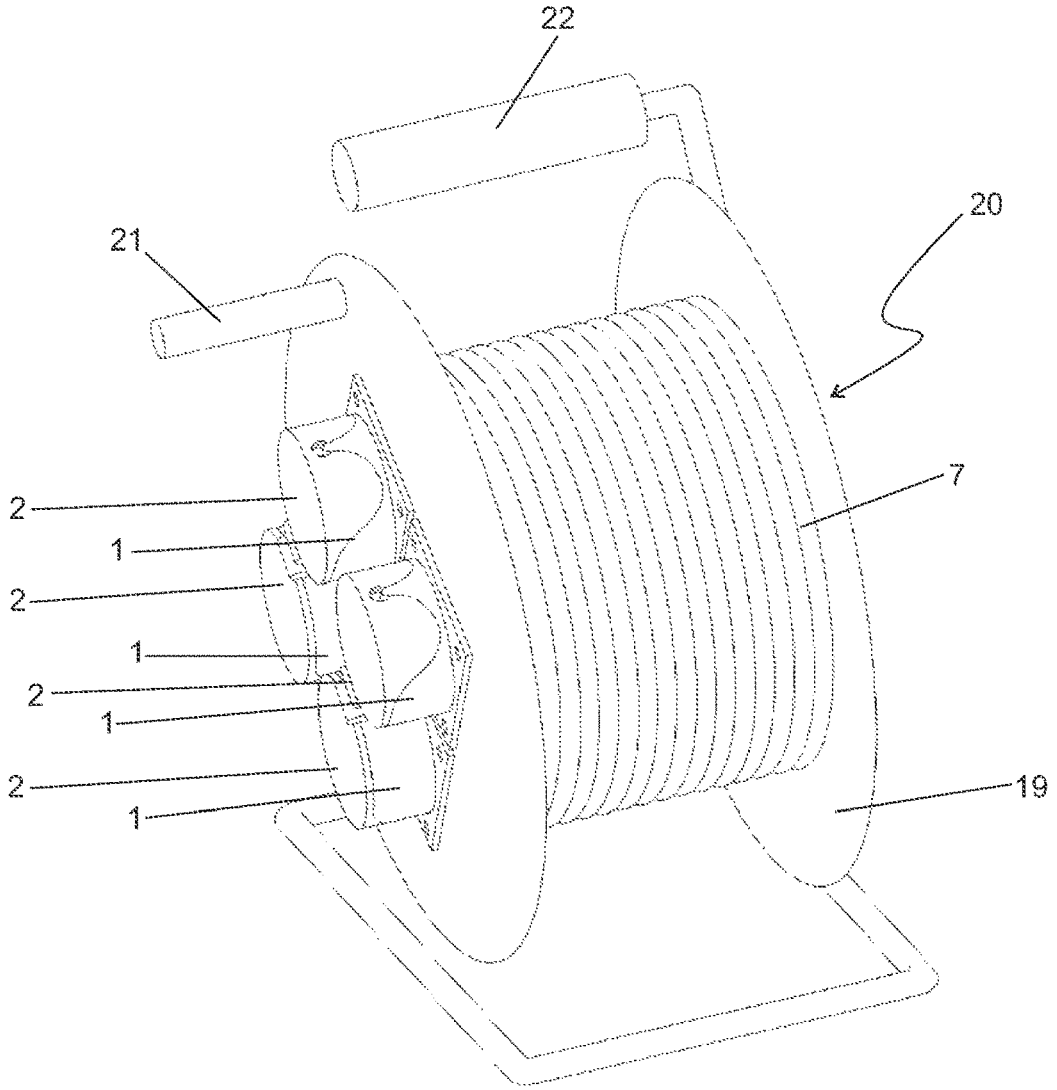
FIG. 8 shows an extension reel with multiple sockets in perspective view.

FIG. 8 shows an extension reel 20. The extension reel 20 comprises a reel core 19 and a lead 7. The reel core 19 is provided with a crank handle 21 for reeling in the lead 7 and a handle 22 for carrying the extension reel 20. Four sockets 1 with a cover 2 are mounted on the side of the reel core 19. The sockets 1 are in electrical contact with the first end of the lead 7. In the second end of the lead 7 there is a plug 8 (not shown).

Figure 9:
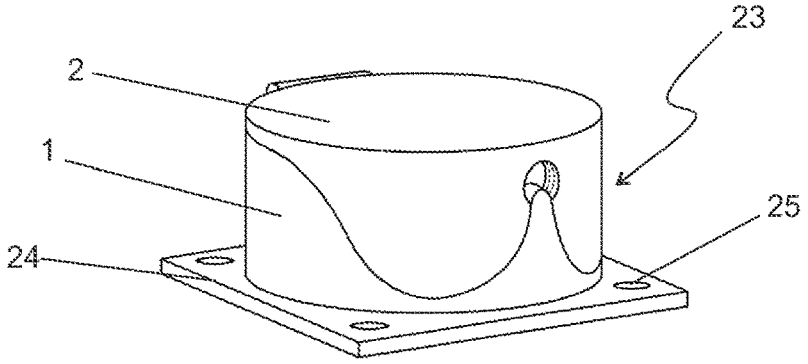
FIG. 9 shows a wall mountable socket in perspective view.

FIG. 9 shows a wall mountable plug point 23. The plug point 23 comprises a socket 1 with a cover 2. The socket 1 is fitted on a mounting plate 24. The mounting plate 24 has screw holes 25 in its corners.

Figure 10A:
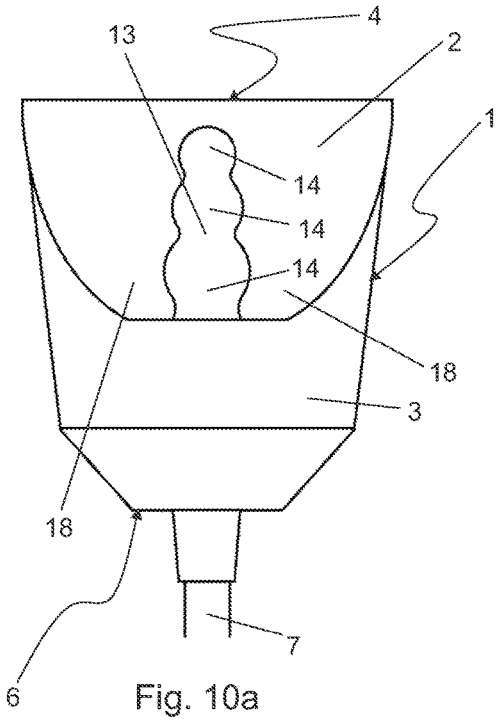
FIG. 10*a* shows a socket in front view.
Figure 10B:
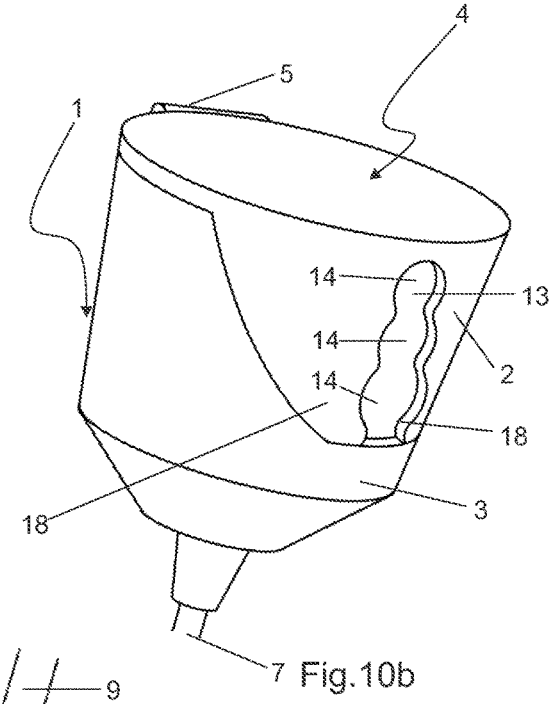
FIG. 10*b* shows a socket with a closed cover in perspective view.
Figure 10C:
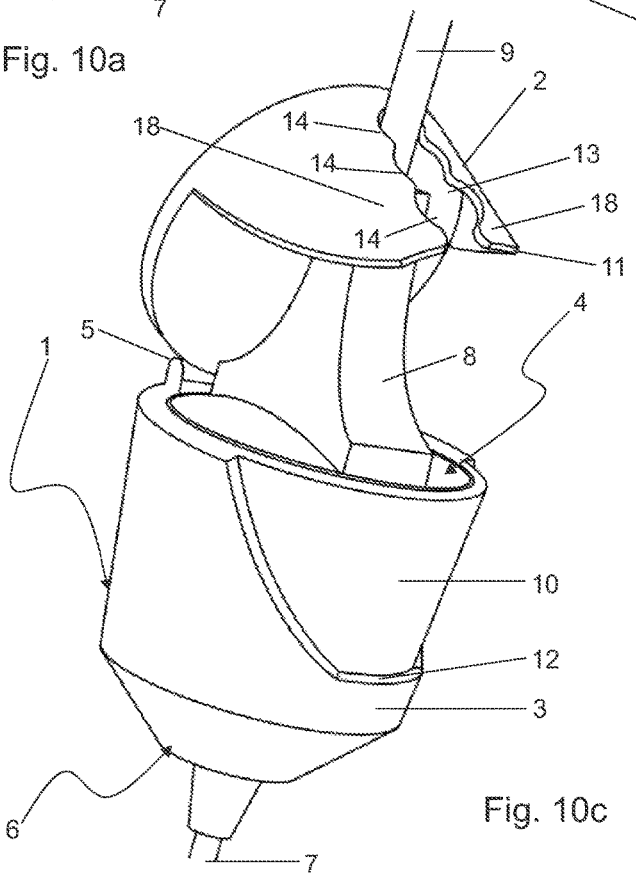
FIG. 10*c* shows a socket and a plug in perspective view.

FIGS. 10*a*-10*c* show a socket 1 having a front side 4 and a rear side 6. A lead 7 extends from the rear side 6 of the socket 1.

The socket 1 has an integrated cover 2, i.e. the cover 2 forms a part of the outer sheath 3 of the socket 1 as can be seen in FIG. 10*c*. The outer sheath 3 comprises a recession 10. The edge 12 of the recession 10 is compatible with the edge 11 of the cover 2. The cover 2 is fastened to the socket 1 with a hinge 5 which is on the front circumference of the sheath 3. The hinge 5 possesses a force which resists opening of the cover 2. In practice, such a force can be accomplished by a spring, i.e. the hinge 5 is spring loaded.

The cover 2 comprises a slot 13 surrounded by sleeves 18. Partly overlapping successive holes 14 form the slot 13. The slot 13 may decrease in width towards the bottom of the slot 13. The edge of the slot 13 may be smoothened so that there are no pointed parts in the slot 13. However, the design of slot may vary depending on the material choice.

The slot 13 with the partly overlapping successive holes 14 form a retainer of the invention. In use, as can be seen from FIG. 10*c*, the cover 2 of the socket 1 is open but the force prevailing in the hinge 5 resists opening of the cover 2. The retainer engages the plug 8 and/or the lead 9. Depending on the size of the plug 8, the slot 13 may be responsible for capturing the plug 8, or the holes 14 may be responsible for capturing the lead 9. As the slot 13 increases in width towards the edge of the cover, i.e. the overlapping successive holes 14 have different diameters, the slot 13 is capable of capturing leads 9 with different diameters.

Figure 11A:
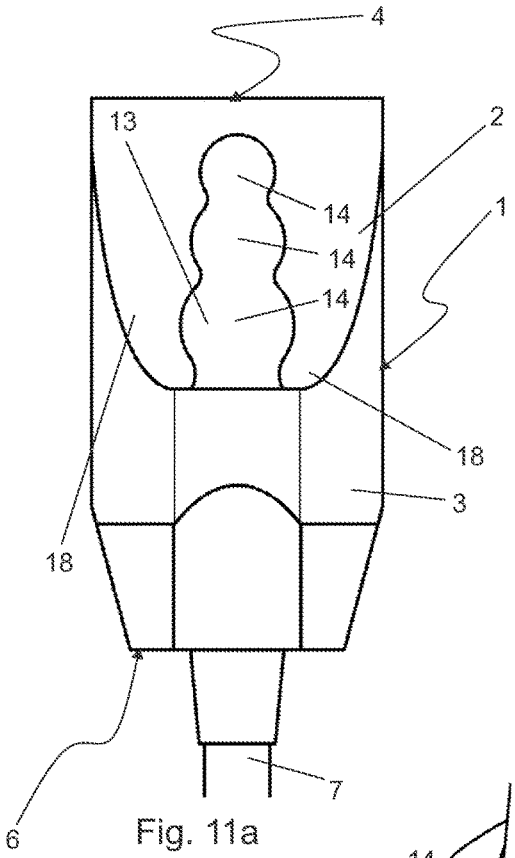
FIG. 11*a* shows a socket in front view.
Figure 11B:
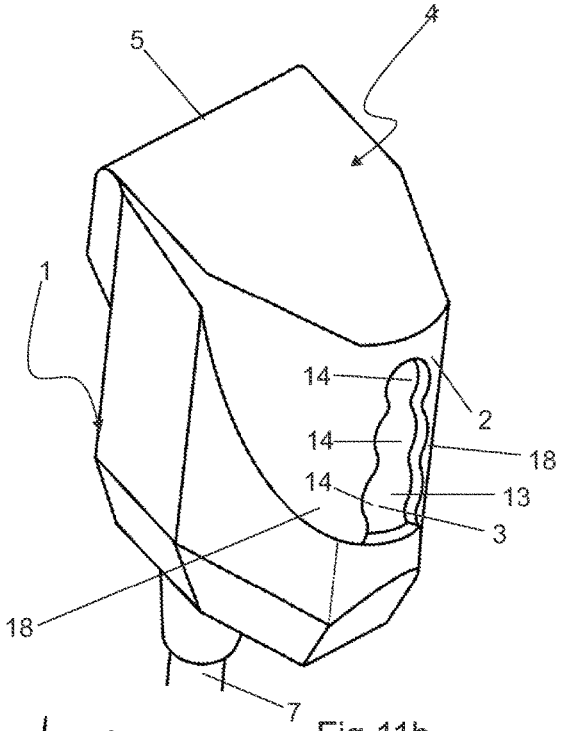
FIG. 11*b* shows a socket with a closed cover in perspective view.
Figure 11C:
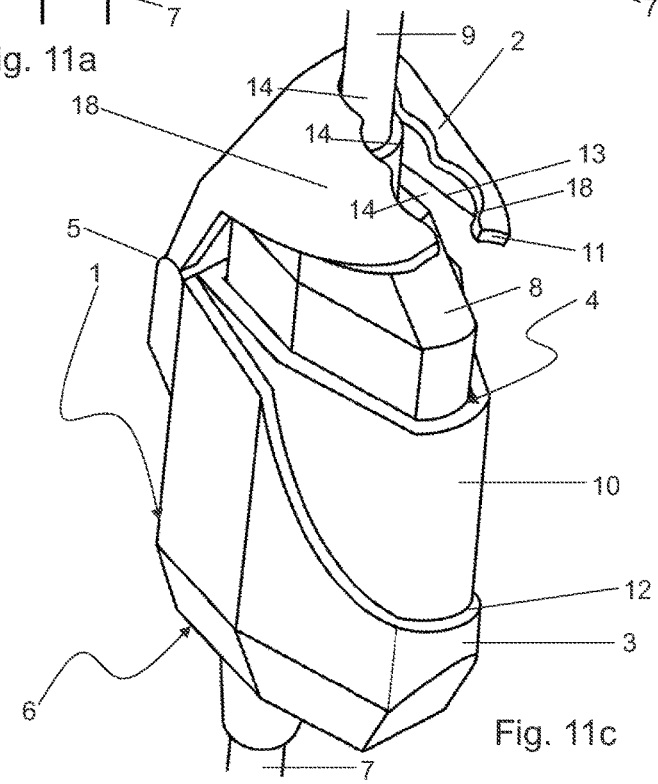
FIG. 11*c* shows a socket and a plug in perspective view.

FIGS. 11*a* to 11*c* show a socket 1 and a plug 8 according to a different standard compared to FIGS. 10*a*-10*c*. However, the arrangement in FIGS. 11*a* to 11*c* is an analogue to the arrangement shown in FIGS. 10*a* to 10*c*.

Figure 12:
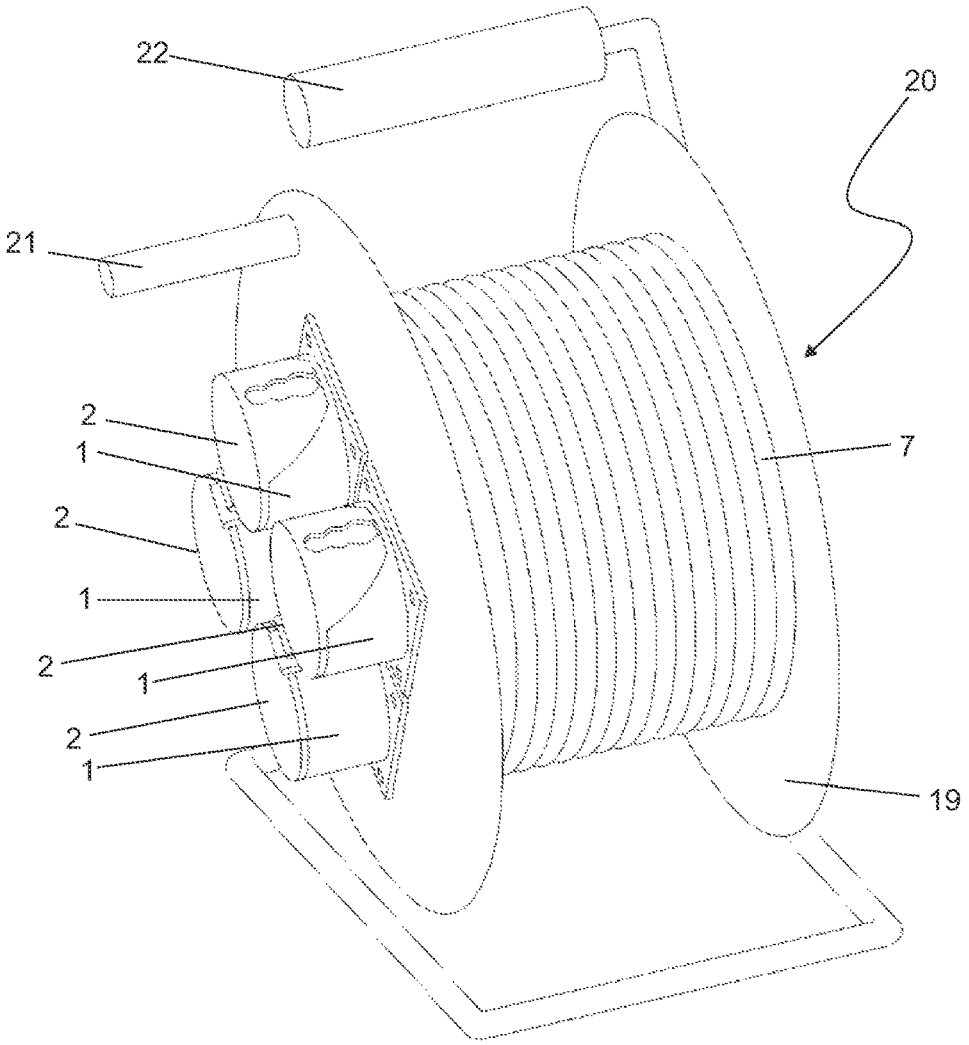
FIG. 12 shows an extension reel with multiple sockets in perspective view.

FIG. 12 shows an extension reel 20. The extension reel 20 comprises a reel core 19 and a lead 7. The reel core 19 is provided with a crank handle 21 for reeling in the lead 7 and a handle 22 for carrying the extension reel 20. Four sockets 1 with a cover 2 are mounted on the side of the reel core 19. The sockets 1 are in electrical contact with the first end of the lead 7. In the second end of the lead 7 there is a plug 8 (not shown).

The cover 2 comprises a slot 13 with the partly overlapping successive holes 14 which form a retainer of the invention.

Figure 13:
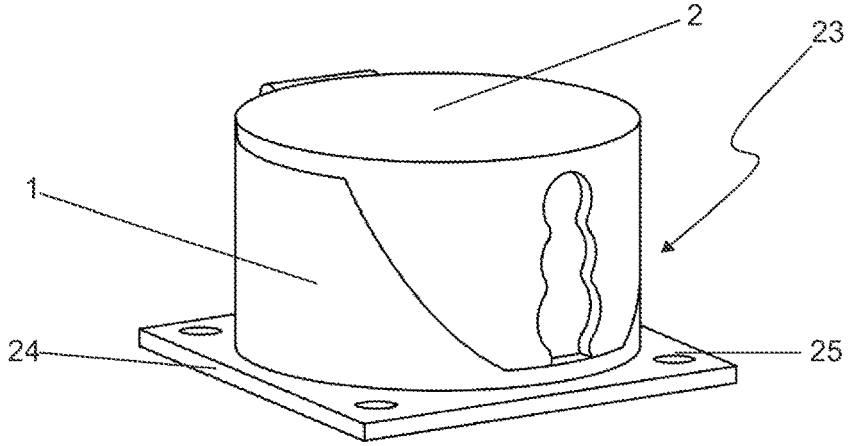
FIG. 13 shows a wall mountable socket in perspective view.

FIG. 13 shows a wall mountable plug point 23. The plug point 23 comprises a socket 1 with a cover 2. The socket 1 is fitted on a mounting plate 24. The mounting plate 24 has screw holes 25 in its corners.

The cover 2 comprises a slot 13 with the partly overlapping successive holes 14 which form a retainer of the invention.

In figures, FIGS. 1*a* to 6*b*, FIGS. 8, 9, 10*a* to 10*c*, 12 and 13 show a socket according to a European standard (CEE 7/4), FIGS. 7*a* to 7*e* and FIGS. 11*a* to 11*c* show a socket according to a United States standard (NEMA 15-5). However, the invention is not limited to any standard but it can be applied in sockets according to different standards. In addition to the above mentioned variations, the described slot forms can be utilized with any cover described in this text.

The invention claimed is:

1. An extension cord comprising:

a lead having a first end and a second end, the first end comprising a socket having a cover and the second end comprising a plug, the cover being attached to the socket by a hinged joint possessing a force which resists opening of the cover, wherein:

the socket includes a front side, a rear side, and a sheath between the front side and the rear side, the cover includes a first portion that covers the front side of the socket and a second portion that extends over the sheath from the front side toward the rear side, and the second portion of the cover comprises a retainer, the retainer including a slot and a hole at the bottom of the slot, the slot decreasing in width from an edge of the second portion to the hole.

2. The extension cord according to claim 1, wherein the second portion of the cover is at an opposite side of the first cover relative to the hinged joint.

3. The extension cord according to claim 1, wherein the slot includes a plurality of partly overlapping successive holes, which includes the hole.

4. The extension cord according to claim 1, wherein the socket is configured to receive a front side of an additional plug, and the retainer is configured to grip a rear side of the additional plug or a lead extending from the rear side of the additional plug.

5. A socket having a cover, the cover being attached to the socket by a hinged joint possessing a force which resists opening of the cover, wherein:

the socket includes a front side, a rear side, and a sheath between the front side and the rear side, the cover includes a first portion that covers the front side of the socket and a second portion that extends over the sheath from the front side toward the rear side, and the second portion of the cover comprises a retainer, the retainer including a slot and a hole at the bottom of the slot, the slot decreasing in width from an edge of the second portion to the hole.

6. The socket according to claim 5, wherein the socket has an integrated cover.

7. The socket according to claim 5, wherein the socket has a cover having an oval shape in a direction transverse to the central axis of the socket.

8. The socket according to claim 5, wherein the socket has a cover having a shape that is partially enlarged in a direction transverse to the central axis of the socket.

9. The socket according to claim 5, wherein the socket has a cover having a shape that is completely enlarged in a direction transverse to the central axis of the socket.

10. The socket according to claim 5, wherein the socket is configured to receive a front side of a plug, and the retainer is configured to grip a rear side of the plug or a lead extending from the rear side of the plug.

11. A cover of a socket, wherein:

the cover includes a first portion that covers a front side of the socket and a second portion that extends over a sheath of the socket that is between the front side of the socket and a rear side of the socket, the second portion extending from the front side toward the rear side, and the second portion of the cover comprises a retainer, the retainer including a slot and a hole at the bottom of the slot, the slot decreasing in width from an edge of the second portion to the hole.

12. The cover according to claim 11, wherein the socket is configured to receive a front side of a plug, and the retainer is configured to grip a rear side of the plug or a lead extending from the rear side of the plug.

* * * * *